US006669401B1

(12) United States Patent
Lin

(10) Patent No.: US 6,669,401 B1
(45) Date of Patent: Dec. 30, 2003

(54) CONNECTION MECHANISM FOR A BENCH HAVING SLATS

(76) Inventor: Patrick Lin, 5F, No. 121, Sec. 3, Minsheng E. Rd., Taipei (TW)

( * ) Notice: Subject to any disclaimer, the term of this patent is extended or adjusted under 35 U.S.C. 154(b) by 0 days.

(21) Appl. No.: 10/265,691

(22) Filed: Oct. 8, 2002

(51) Int. Cl.[7] ..... F16B 9/00
(52) U.S. Cl. ..... 403/408.1; 297/440.1
(58) Field of Search ..... 297/440.1; 403/408.1, 403/258, 259, 257, 256, 230, 367, 366, 345, 380

(56) References Cited

U.S. PATENT DOCUMENTS 3,835,615 A * 9/1974 King, Jr. ..... 403/408.1
5,224,753 A * 7/1993 Fox ..... 297/440.1 X
5,480,117 A * 1/1996 Fleming, III ..... 403/408.1 X
5,529,428 A * 6/1996 Bischof ..... 403/408.1
5,961,243 A * 10/1999 Michaluk, III ..... 403/408.1 X

* cited by examiner

*Primary Examiner*—John R. Cottingham
(74) *Attorney, Agent, or Firm*—Fei-Fei Chao; Venable LLP

(57) ABSTRACT

A connecting device for a bench or a chair having multiple hollow slats includes an inner piece slidably received in a corresponding one of the slats and having a first compartment, a second compartment and a third compartment respectively defined in the inner piece and separated by baffles in the inner piece. A plug is detachably connected to the inner piece and has a seat integrally formed with the plug and having a through hole with a first step and a second step formed on an inner surface defining the through hole. A bolt-nut combination has a bolt to extend through a bottom face of a corresponding one of the slats, the inner piece and into the through hole in the seat and a nut received in the second step to be threadingly connected to the bolt.

7 Claims, 4 Drawing Sheets

CONNECTION MECHANISM FOR A BENCH HAVING SLATS

BACKGROUND OF THE INVENTION

1. Field of the Invention

The present invention relates to a connection device, and more particularly to a connection device for a bench having multiple slats.

2. Description of Related Art

A conventional bench or chair (5) having multiple slats (51) is shown in FIGS. 4 and 5. The slats (51) of the bench (5) are connected together by at least two end pieces (or legs) (52). Countersunk holes (53) are defined in the slats (51) to allow the extension of screws (54) to combine the slats (51) and the end pieces (52).

This kind of connection between the slats (51) and the end pieces (52) is accomplished by the bolts (54) extending through the countersunk holes (53) in the slats (51) and the holes on the end pieces (52). That is, each slat (51) has at least one countersunk hole (53) defined therethrough, which spoils the overall appearance of the stool (5).

To overcome the shortcomings, the present invention tends to provide an improved connection device for a bench having multiple slats to mitigate and obviate the aforementioned problems.

SUMMARY OF THE INVENTION

The primary objective of the present invention is to provide an improved connection device for a chair having multiple slats. Each of the slats is hollow and has an inner piece slidably received in the slat. The inner pieces are made of a metal and two plugs are respectively connected to opposite ends of the inner piece. The plug has a through hole defined in a seat integrally formed with and extending out of the plug. A first step and a second step are formed in an inner face defining the through hole. The first step has a dimension larger than that of the second step. A nut is received in the through hole and supported by the second step. A washer is also received in the through hole and supported by the first step. A bolt extends into the through hole from an outer surface of the slat and an outer surface of the inner piece to threadingly connect to the nut. Therefore, when the bolt finishes combination with the nut, top surfaces of the slats are free of any bolt protrusion and the connection pieces to combine the slats are thus easily connected to the slats by the bolt. Thereafter, the entire top surfaces of the slats of the stool are smooth.

Other objects, advantages and novel features of the invention will become more apparent from the following detailed description when taken in conjunction with the accompanying drawings.

DETAILED DESCRIPTION OF THE PREFERRED EMBODIMENT

Figure 1:
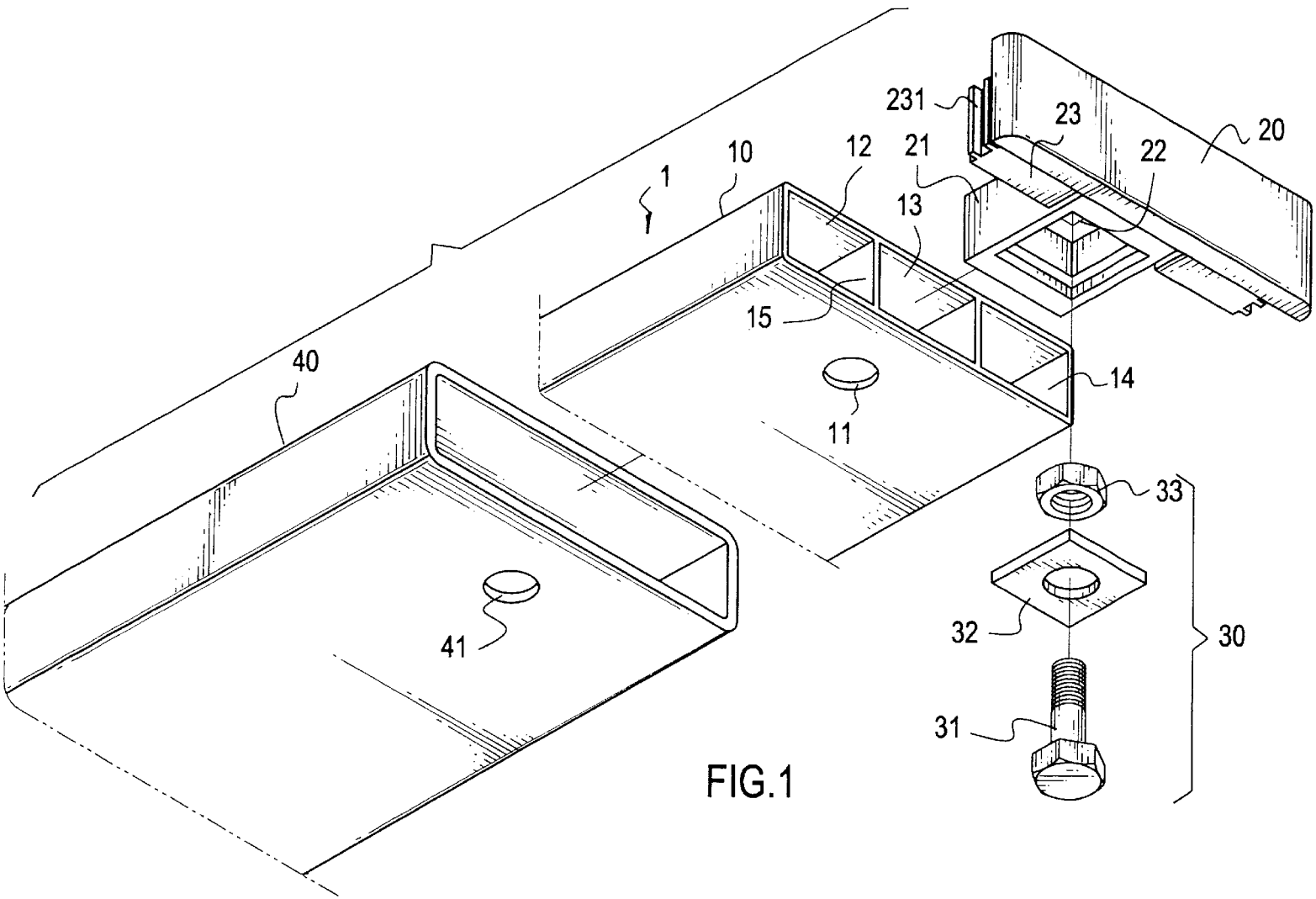
FIG. 1 is an exploded perspective view of the connection device of the present invention.
Figure 2:
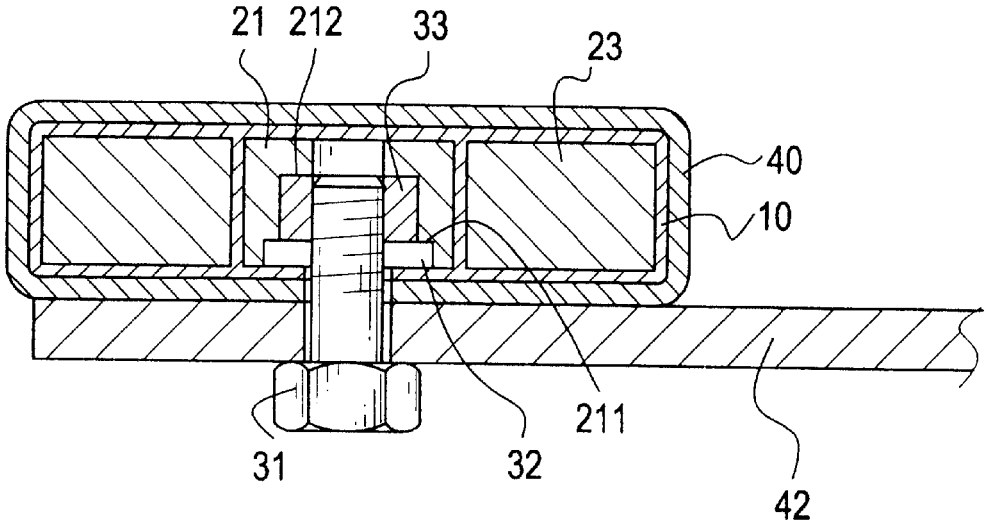
FIG. 2 is a cross sectional view of the connection device implemented to the slat of a stool.
Figure 5:
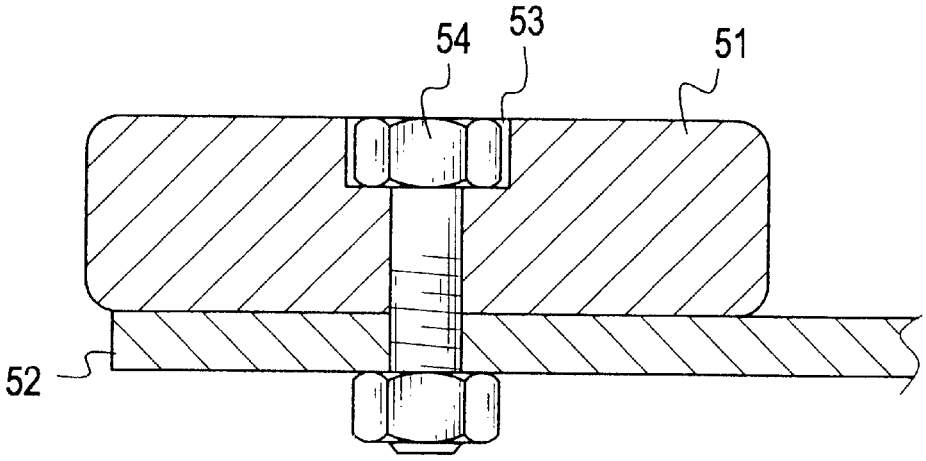
PRIOR ART FIG.5
FIG. 5 is a cross sectional view of the conventional connection device to combine the slat and the end piece.

With reference to FIGS. 1 and 2, the connection device (1) in accordance with the present invention includes an inner piece (10), a plug (20) and a bolt-nut combination (30).

A bench (not shown) has multiple hollow slats (40). Each of the hollow slats (40) has a first hole (41) and is provided with one inner piece (10) which has a second hole (11) defined in a bottom surface of the inner piece (10) to correspond to the first hole (41).

The inner piece (10) further has a first, a second and a third compartment (12,13,14) respectively separated from each other by baffles (15).

The plug (20) has a seat (21) integrally formed with the plug (20) and having a through hole (22) defined through the seat (21), a first step (211) and a second step (212) respectively defined in an inner surface defining the through hole. The first step (211) has a dimension larger than that of the second step (212). The plug (20) further has two wings (23) integrally formed with the plug (20) to sandwich the seat (21) therebetween. Each wing (23) has an undulated end face (231).

The bolt-nut combination (30) includes a bolt (31), a washer (32) and a nut (33).

When the connection device (1) of the present invention is to be assembled, the first hole (41) aligns with the second hole (11) and then the nut (33) is received in the through hole (22) and supported by the second step (212). The washer (32) is also received in the through hole (21) and supported by the first step (211). After the seat (21) together with the two wings (23) of the plug (20) is slid into the first, the second and the first compartments (12,13,14) of the inner piece (10), the through hole (21) aligns with the second hole (11) so that the extension of the bolt (31) into the first hole (41), the second hole (11) and the through hole (21) of the seat (21) allows the bolt (31) to be threadingly connected to the nut (33).

It is to be noted that at least two connecting pieces (42) are provided to combine the slats (40) and respectively arranged on opposite ends of the slats (40). Therefore, before the bolt (31) extends into the first hole (41) of the slat (40), the bolt (31) extends through the connecting piece (42) such that after all the bolts (31) are positioned, the slats (40) are combined by the connecting pieces (42), as shown in FIG. 2.

Figure 3:
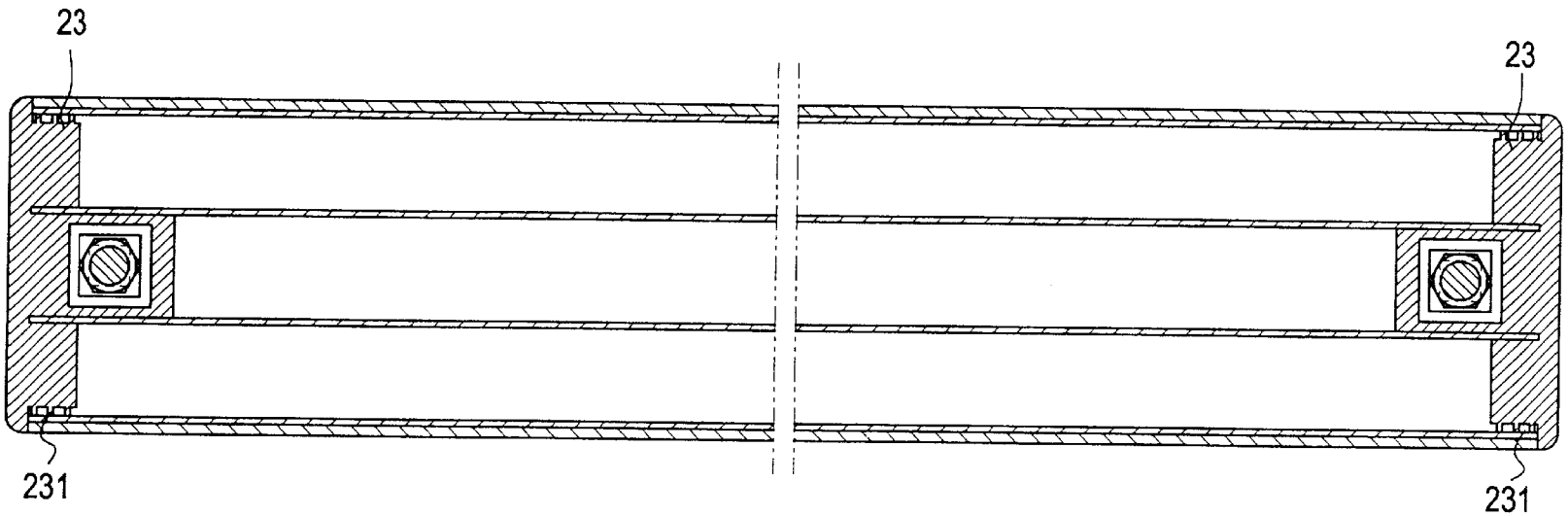
FIG. 3 is a cross sectional view from the bottom of the stool.
Figure 4:
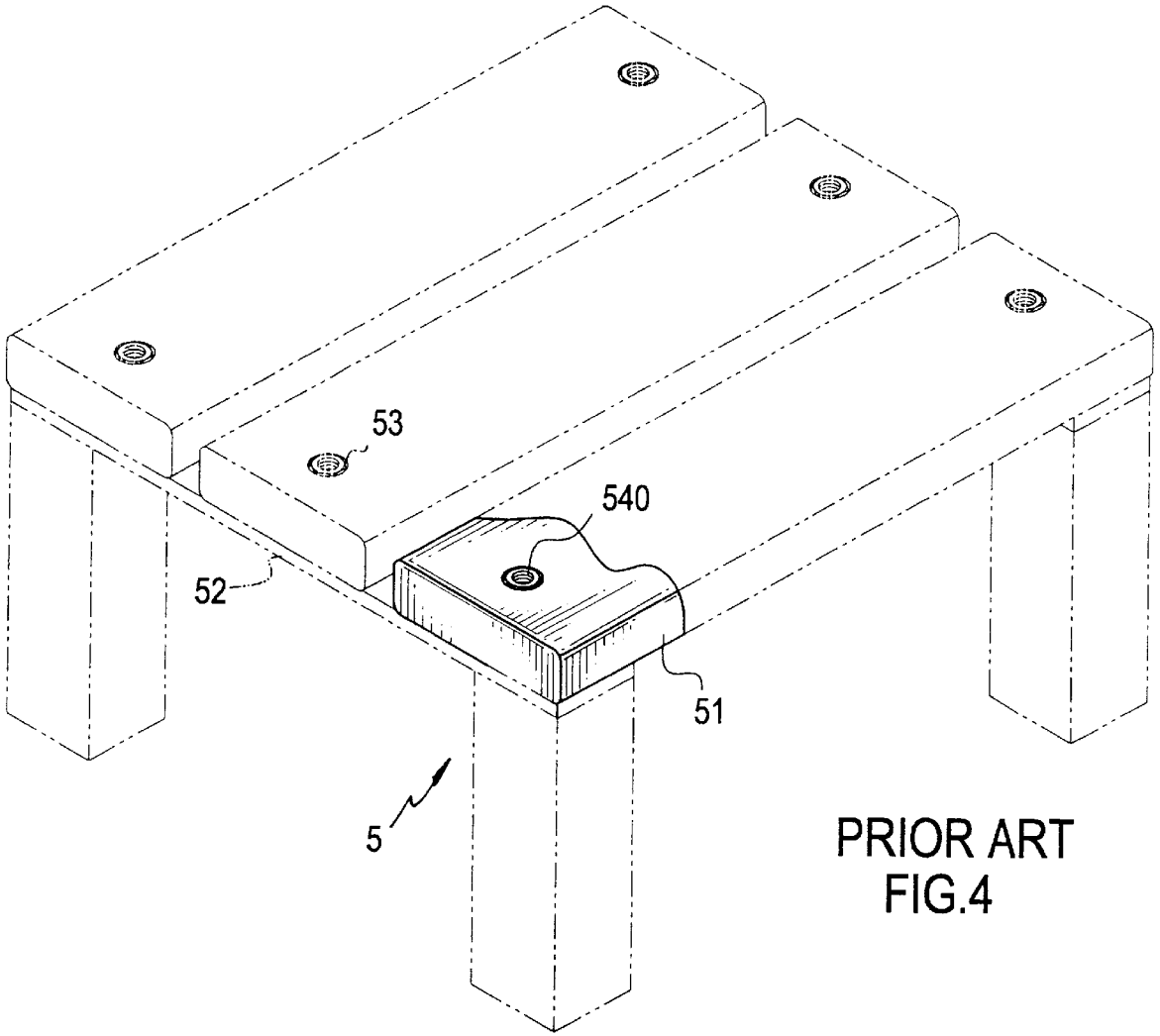
PRIOR ART FIG.4
FIG. 4 is a perspective view of a corner of a stool showing the conventional connection device implemented to the stool.

With reference to FIG. 3, after all the slats (40) are combined by the connecting pieces (42), the bolt heads are on the bottom faces of the slats (40) so that the overall appearance of the stool is smooth, and even after a period of time of using the stool, the user will not have to worry about the damage the stool might cause by a protruding bolt. Furthermore, the undulated end face (231) is able to increase friction with an inner surface of the first and the third compartments (12,14) after the wings (23) are respectively inserted into the first and third compartments (12,14).

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A connecting device for a bench or a chair having multiple hollow slats combined by at least two connecting pieces respectively fitted on opposite ends of the slats, the connecting device comprising:

an inner piece slidably received in a corresponding one of the slats and having a first compartment, a second compartment and a third compartment respectively defined in the inner piece and separated by baffles in the inner piece;

a plug detachably connected to the inner piece and having a seat integrally formed with the plug and having a through hole with a first step and a second step formed on an inner surface defining the through hole; and a bolt-nut combination having a bolt to extend through a bottom face of a corresponding one of the slats, the inner piece and into the through hole in the seat and a nut received in the second step to be threadingly connected to the bolt.

2. The connecting device as claimed in claim 1, wherein the plug further has two wings integrally formed with the plug to sandwich the seat and each wing having an undulated end face to correspond to an inner side face of the first and the third compartments of the inner piece.

3. The connecting device as claimed in claim 2, wherein the bolt-nut combination further has a washer received in the through hole and supported by the first step.

4. The connecting device as claimed in claim 2, wherein the inner piece has a hole defined to align with the through hole.

5. The connecting device as claimed in claim 2, wherein each wing has an undulated side face formed to increase friction with an inner face of the first and third compartments of the inner piece.

6. The connecting device as claimed in claim 3, wherein each wing has an undulated side face formed to increase friction with an inner face of the first and third compartments of the inner piece.

7. The connecting device as claimed in claim 4, wherein each wing has an undulated side face formed to increase friction with an inner face of the first and third compartments of the inner piece.

* * * * *